US006994230B2

(12) United States Patent
Sams

(10) Patent No.: US 6,994,230 B2
(45) Date of Patent: Feb. 7, 2006

(54) REAR LOADING VENDING MACHINE

(75) Inventor: Gary L. Sams, Grand Rapids, MI (US)

(73) Assignee: Industrial Vacuum Systems, Inc., Grand Rapids, MI (US)

( * ) Notice: Subject to any disclaimer, the term of this patent is extended or adjusted under 35 U.S.C. 154(b) by 285 days.

(21) Appl. No.: 10/269,187

(22) Filed: Oct. 11, 2002

(65) Prior Publication Data

US 2004/0069795 A1 Apr. 15, 2004

(51) Int. Cl.
*B65H 1/00* (2006.01)

(52) U.S. Cl. ..... 221/197; 194/202; 312/35

(58) Field of Classification Search ..... 221/75, 221/247, 197, 154, 2, 6; 194/202, 295, 350, 194/206; 312/35, 42
See application file for complete search history.

(56) References Cited

U.S. PATENT DOCUMENTS

| | | | | |
|---|---|---|---|---|
| 3,329,080 | A | 7/1967 | Reach | |
| 3,344,953 | A | 10/1967 | Krakauer et al. | |
| 3,697,148 | A | 10/1972 | Weber | |
| 3,720,350 | A | 3/1973 | Patrick | |
| 3,734,346 | A | 5/1973 | Yingst | |
| 3,756,455 | A | 9/1973 | Patrick | |
| 4,018,359 | A * | 4/1977 | Lambert | 221/14 |
| 4,136,764 | A | 1/1979 | Johnson | |
| 4,196,951 | A | 4/1980 | Lotspeich | |
| 4,350,264 | A * | 9/1982 | Muller | 221/67 |
| 4,668,028 | A * | 5/1987 | Kimoto | 312/116 |
| 4,744,490 | A * | 5/1988 | Albright et al. | 221/75 |
| 4,757,915 | A | 7/1988 | Albright et al. | |
| 4,850,511 | A * | 7/1989 | Kral et al. | 221/154 |
| 5,303,844 | A * | 4/1994 | Muehlberger | 221/1 |
| 5,566,806 | A | 10/1996 | Reale | |
| 5,579,952 | A | 12/1996 | Fiedler et al. | |
| 5,860,714 | A * | 1/1999 | Skord, Jr. | 312/242 |
| 6,019,249 | A | 2/2000 | Michael et al. | |
| 6,170,285 | B1 * | 1/2001 | Huffman et al. | 62/448 |
| 6,279,718 | B1 * | 8/2001 | Nulph et al. | 194/206 |
| 6,330,958 | B1 * | 12/2001 | Ruskin et al. | 221/75 |
| 6,352,175 | B2 * | 3/2002 | Izawa et al. | 221/197 |
| 6,367,653 | B1 * | 4/2002 | Ruskin et al. | 221/1 |
| 6,553,703 | B2 * | 4/2003 | Fowler et al. | 40/666 |
| 6,708,812 | B2 * | 3/2004 | Greim | 194/350 |

FOREIGN PATENT DOCUMENTS

| | | |
|---|---|---|
| JP | 2231698 | 9/1990 |
| JP | 3201183 | 9/1991 |
| JP | 7244774 | 9/1995 |

* cited by examiner

*Primary Examiner*—Richard Ridley
(74) *Attorney, Agent, or Firm*—Price, Heneveld, Cooper, DeWitt & Litton, LLP

(57) ABSTRACT

A vending machine comprising a housing and a service chassis. The housing has an interior, a front face and a rear door pivotally connected to the housing. The front face of the housing includes at least one front opening for allowing a vended product to be removed from the housing. The service chassis is at least partially located within the housing and includes at least one money collecting container. The service chassis can be slid into and out of the interior of the housing for allowing access to the at least one money collecting container. A method of loading the vending machine is also disclosed.

25 Claims, 13 Drawing Sheets

REAR LOADING VENDING MACHINE

BACKGROUND OF THE INVENTION

The present invention relates to vending machines, and in particular to a rear loading vending machine.

Vending machines have been used for many years to dispense a variety of different products. For example, vending machines dispense soft drinks, food products, candy bars, snack foods, or specific products associated with specific activities which occur at the dispensing area, such as vending machines for dispensing automobile protectant, towels, glass cleaner, and similar products at car washes.

Heretofore, vending machines have typically included a housing for storing the vending products and a conventional dispensing mechanism which can be accessed through conventional coin/token/card/paper money acceptors. Such vending machines can be filled through either a front or a rear access door and the vending products are normally dispensed through a front dispensing guide and/or dispensing opening. However, one problem with vending machines is that the doors have been able to be vandalized by prying a side of the front housing outward to access the money and vending products in the interior of the vending machine.

One attempt at trying to protect money within the vending machine is disclosed in U.S. Pat. No. 5,860,714. U.S. Pat. No. 5,860,714 discloses a vending machine that can be placed into a wall and includes a rear housing that pivots away from the wall to allow the housing to be filled with goods and the money within the housing to be withdrawn. However, the housing requires space to pivot away from the wall. Therefore, the housing of U.S. Pat. No. 5,860,714 cannot be placed next to a corner because the housing would then not be able to pivot.

Vending machines have also experienced problems when the product being bought does not fall to a front dispensing opening. Typically, vending machines selling candy or automobile related products have screws that rotate and thereby push the vending product to a front of a shelf, wherein the vending product falls into a tray adjacent the front dispensing opening. However, sometimes the vending product can get stuck between walls of the lane holding the vending product and the vending product will not fall.

Accordingly, a vending machine solving the aforementioned disadvantages and having the aforementioned advantages is desired.

SUMMARY OF THE INVENTION

One aspect of the present invention is to provide a vending machine comprising a housing, a rear door and a service chassis. The housing has a front, a rear, a top, a bottom and two sides. The front, rear, top, bottom and two sides define an interior of the housing. The front of the housing includes a front wall having at least one front opening configured to allow a vending product to be removed from the housing. The rear door is pivotally connected to the housing and covers at least a portion of the rear of the housing. The rear door has an open position allowing access to the interior of the housing. The rear door further has a closed position for preventing access to the interior of the housing through the rear of the housing. The service chassis has at least one money collecting container. The service chassis is configured to be located within the interior of the housing when the rear door is in the closed position. The at least one money container has a money accepting slot adjacent the front of the housing when the service chassis is within the interior of the housing whereby money is inserted into the at least one money collecting container through the money accepting slot. The service chassis is configured to be at least partially removed from the interior of the housing through the rear of the housing to allow access to the at least one money collecting container and the money accepting slot of the at least one money collecting container.

Another aspect of the present invention is to provide a vending machine comprising a housing and a service chassis. The housing has an interior, a front face and a rear door pivotally connected to the housing. The front face of the housing includes at least one front opening for allowing a vended product to be removed from the housing. The service chassis is at least partially located within the housing and has at least one money collecting container. The housing includes a track located within the housing. The track allows the service chassis to be slid into and out of the interior of the housing. The service chassis includes a pivotable frame member, thereby allowing the pivotable frame member to be pivoted after the service chassis is slid out of the interior of the housing.

Yet another aspect of the present invention is to provide a method of loading a vending machine comprising placing a first design in each lane of the vending machine signifying a width of the lane and placing a second design on each vending product signifying a width of the vending product. The method also includes placing each vending product into one of the lanes of the vending machine, wherein the first design for at least one lane is identical to the second design for the vending products placed therein.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
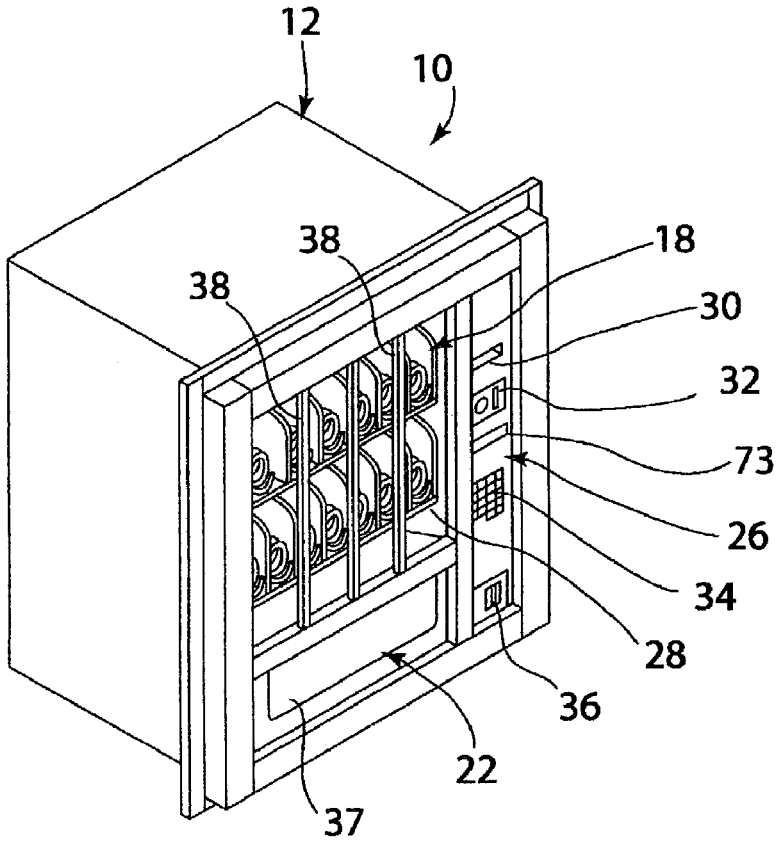
FIG. 1 is a front perspective view of a rear loading vending machine embodying the present invention with a rear door in a closed position.
Figure 2:
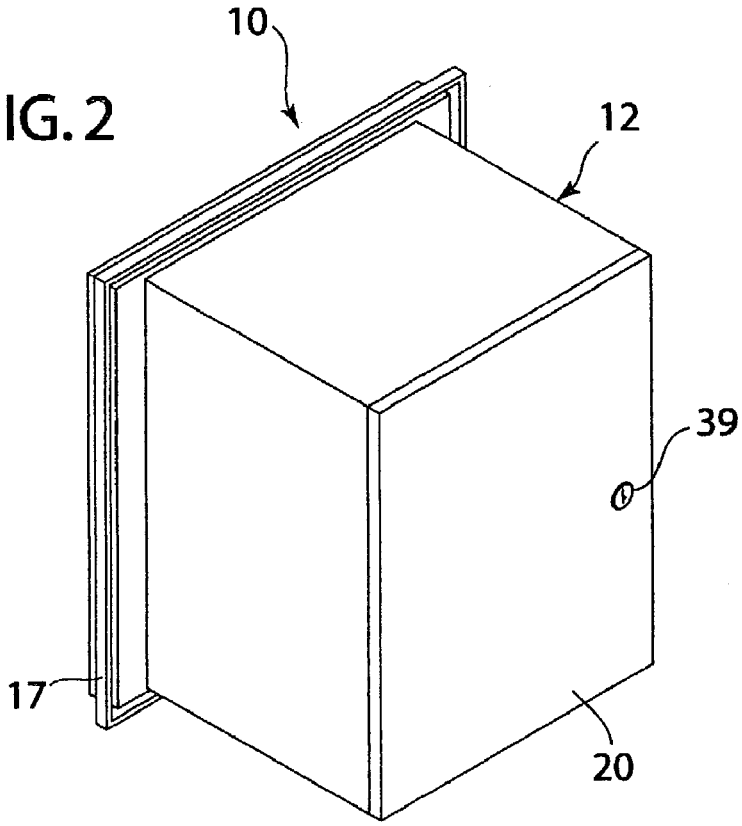
FIG. 2 is a rear perspective view of the rear loading vending machine embodying the present invention with the rear door in the closed position.
Figure 3:
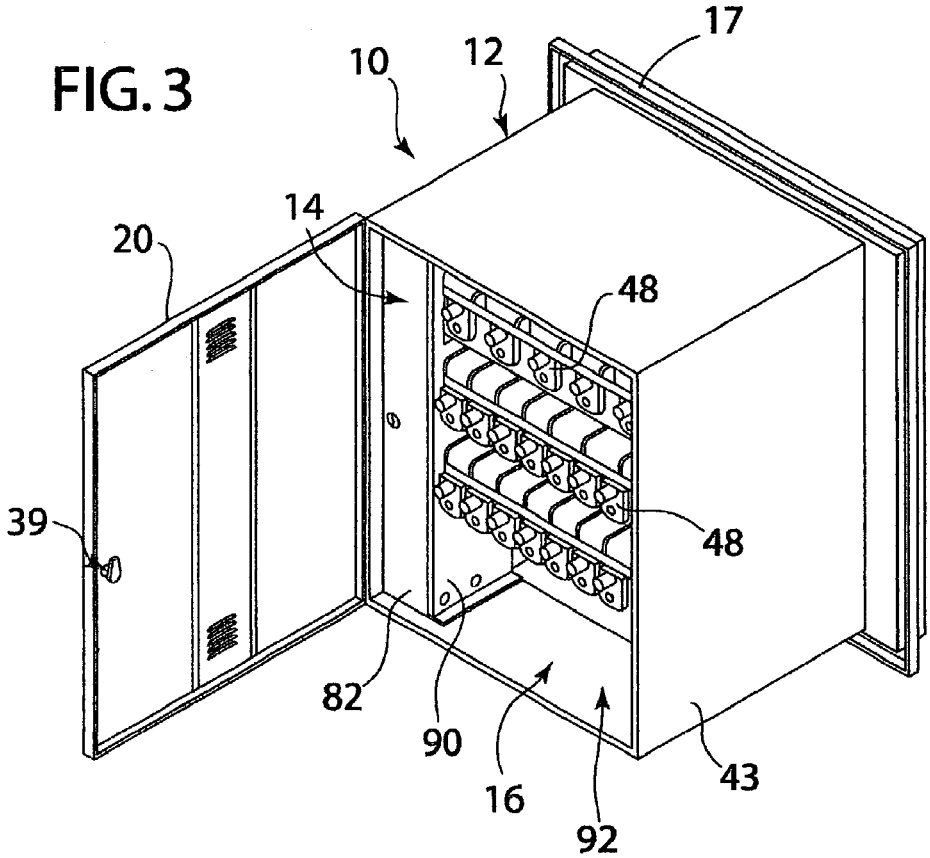
FIG. 3 is a rear perspective view of the rear loading vending machine embodying the present invention with the rear door in an open position and a chassis in a stored position.
Figure 4:
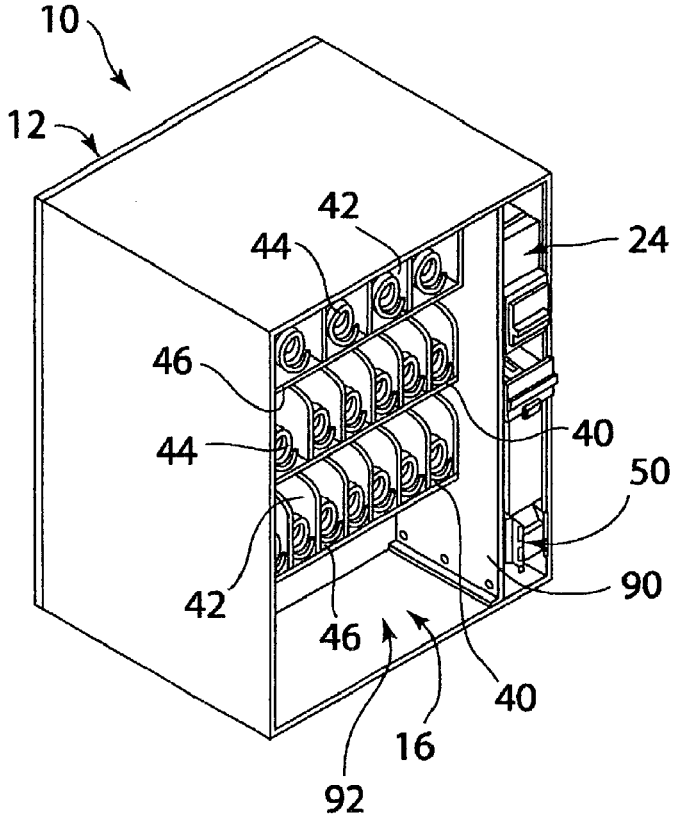
FIG. 4 is a front perspective view of the rear loading vending machine embodying the present invention with a front panel removed to illustrate details of the interior of the rear loading vending machine.
Figure 5:
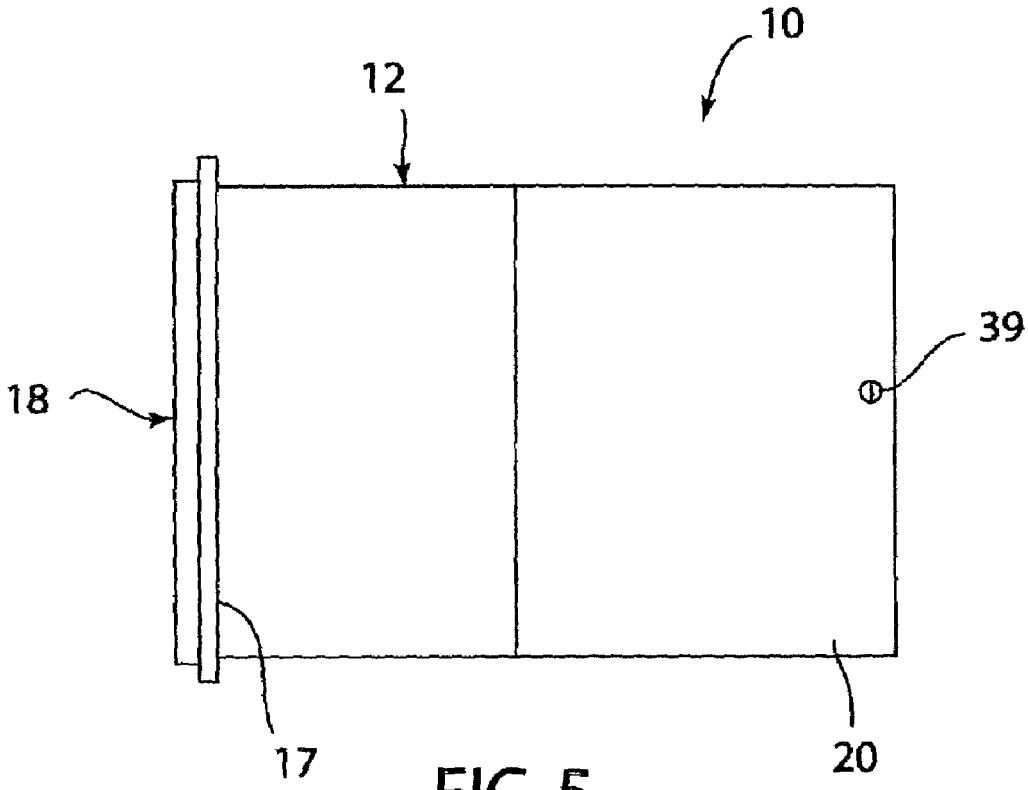
FIG. 5 is a side view of the rear loading vending machine embodying the present invention with the door in the open position.
Figure 6:
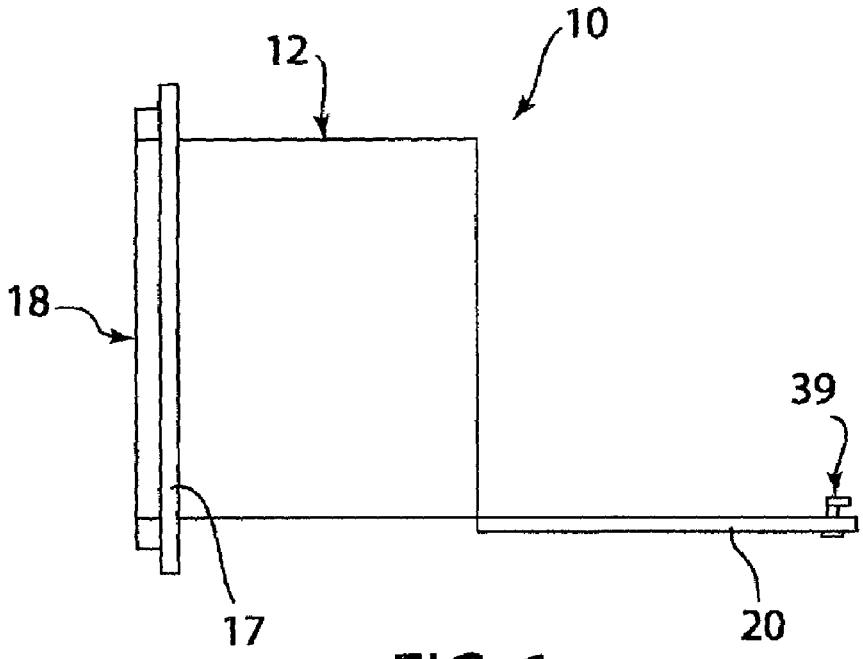
FIG. 6 is a top view of the rear loading vending machine embodying the present invention with the door in the open position.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1–6) generally designates a rear loading vending machine embodying the present invention. In the illustrated example, the rear loading vending machine 10 comprises a housing 12 and a service chassis 14. The housing 12 has an interior 16, a front face 18 and a rear door 20 pivotally connected to the housing 12. The front face 18 of the housing 12 includes at least one front opening 22 for allowing a vended product to be removed from the housing 12. The service chassis 14 is at least partially located within the housing 12 and includes at least one money collecting container 24. The service chassis 14 can be slid into and out of the interior 16 of the housing 12 for allowing access to the at least one money collecting container 24.

In the illustrated example, the rear loading vending machine 10 is configured to be positioned into an opening in a wall (not shown) with the front opening 22 being the only access to the interior 16 of the housing 12 through the front of the wall and the rear door 20 allowing access to the interior 16 of the housing through the rear of the wall. The front face 18 of the housing 12 has a peripheral rim 17 that overlaps the front of the wall when the rear loading vending machine is positioned into the wall. The front face 18 includes a money and selection panel 26, a transparent front panel 28 and the front opening 22. The transparent front panel 28 allows a user of the vending machine 10 to peer within the interior 16 of the housing 12 to choose a vending product. Thereafter, money is inserted into the money and selection panel 26 and the vending product is selected using the money and selection panel 26. The user of the rear loading vending machine 10 can then retrieve the vending product through the front opening 22. The illustrated money and selection panel 26 of the front face 18 of the housing 12 includes a paper money slot 30, a first coin slot 32 for accepting coins, a keyboard 34, and a second coin slot 36 for the return of rejected coins. Typically, the vending product will fall into a tray (not shown) in the bottom of the housing 12 upon insertion of paper money into the paper money slot 30 and/or insertion of coins into the first coin slot 32 and selection of a particular vending product with the keyboard 34, as is well known to those skilled in the art. The front opening 22 includes an access door 37 allowing access to the vending product in the tray as also is well known to those skilled in the art. Preferably, the transparent front panel 28 includes bars 38 to prevent vandals from damaging the vending machine 10. The rear door 20 includes a lock 39 (similar to a desk drawer lock) having a lock tooth 41 with a slot 45 configured to engage a mating lock tooth having a slot attached to a first side wall of the housing 12 in order to maintain the rear door 20 in a closed position.

The illustrated vending machine 10 includes a plurality of vending products (not shown) for sale therein. The vending products are displayed on a plurality of shelves 40 having lanes 42 thereon. Preferably, each lane 42 has a plurality of identical vending products thereon. The vending products are moved along the lanes 42 when they are selected using the keyboard 34 by rotating a screw 44 in the lane 42 that corresponds to the selection made on the keyboard 34. Once the vending product reaches an end 46 of the shelf 40, the vending product will fall into the tray. Each of the screws 44 is connected to a motor 48 that rotates the screw 44 in accordance with instructions received from a controller (not shown). Screws 44 and motors 48 used in vending machines are well known to those skilled in the art.

Figure 7:
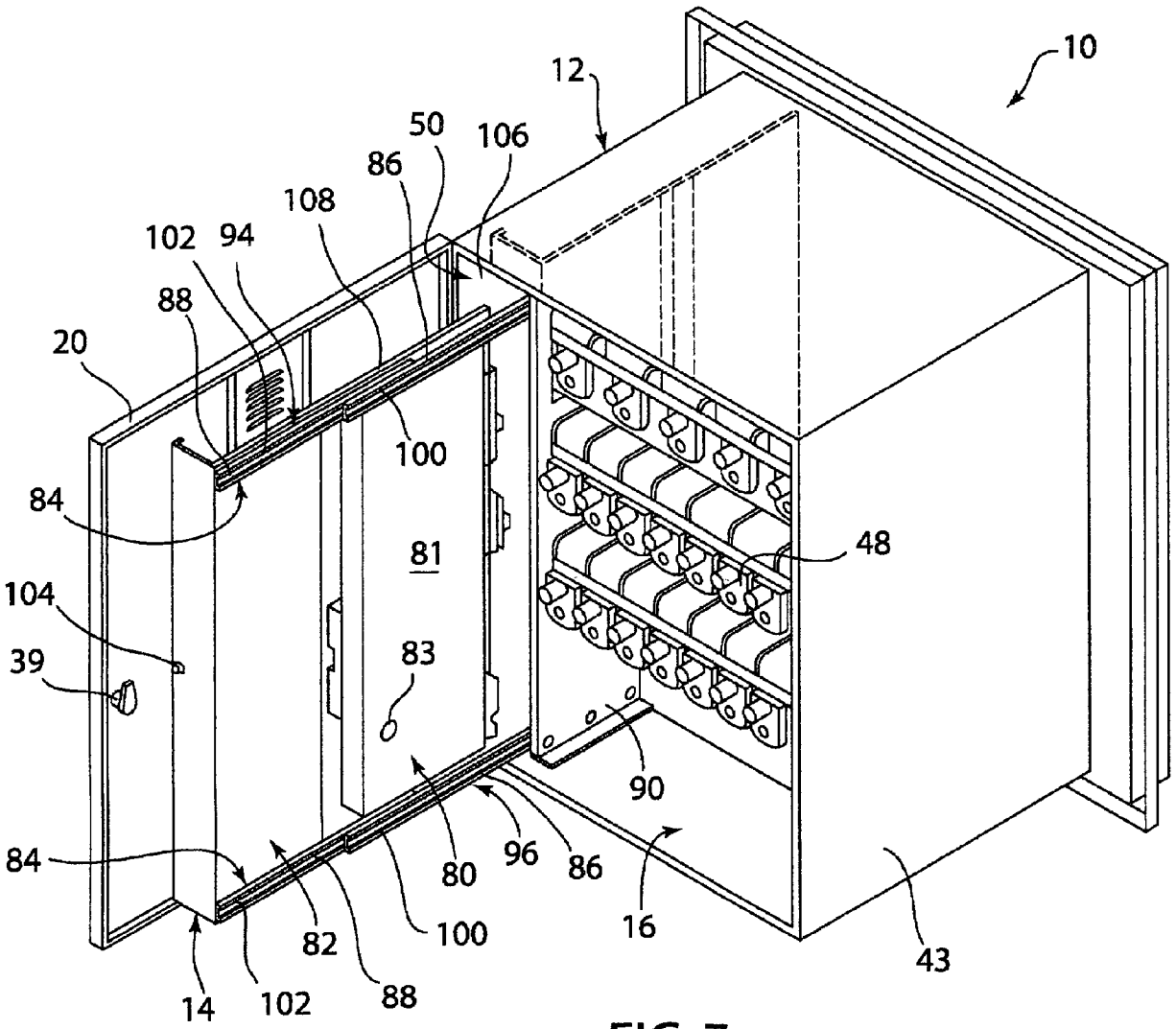
FIG. 7 is a rear perspective view of the rear loading vending machine embodying the present invention with the rear door in the open position and the chassis in an intermediate position.
Figure 8:
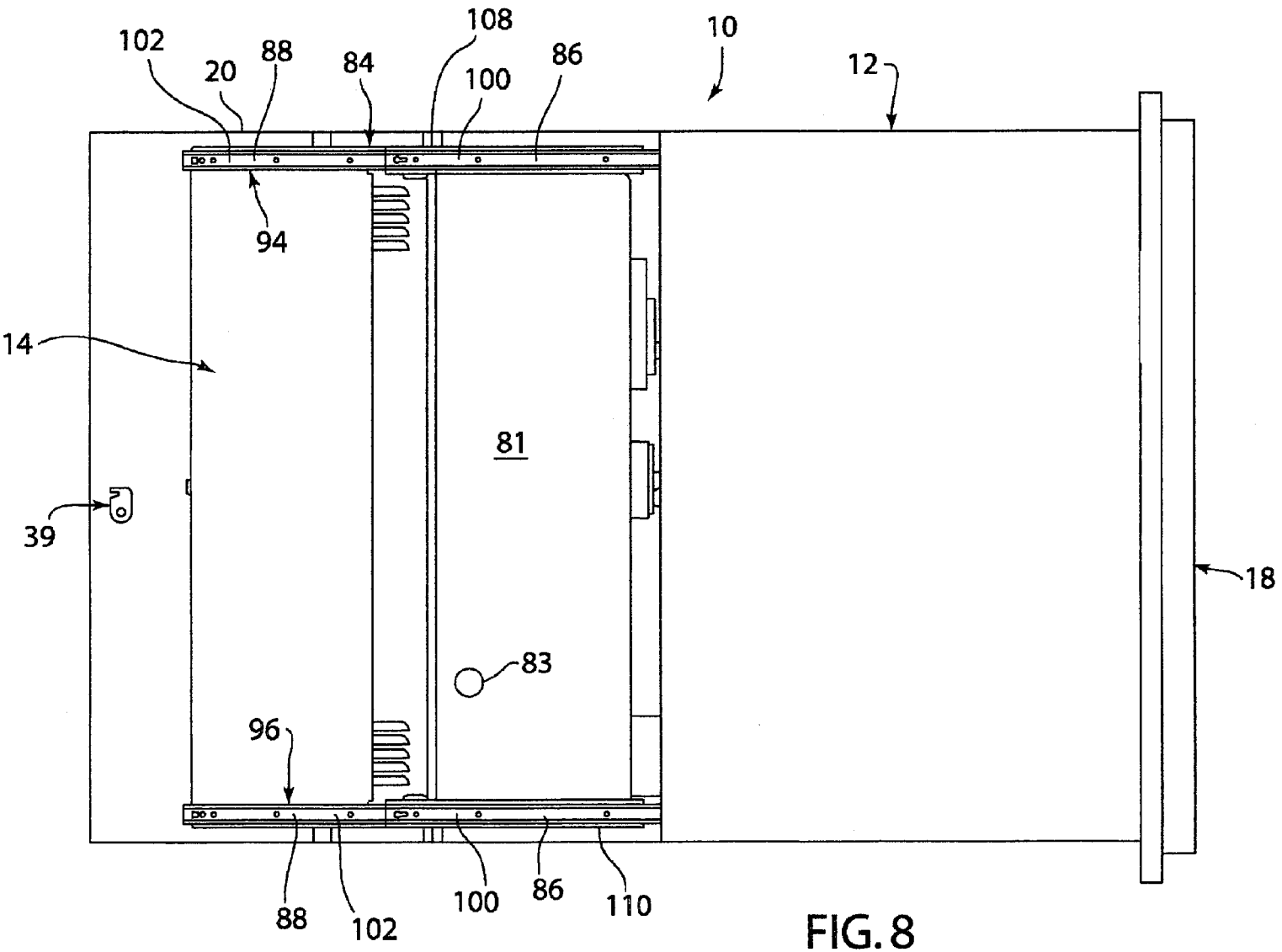
FIG. 8 is a side view of the rear loading vending machine embodying the present invention with the rear door in the open position and the chassis in the intermediate position.
Figure 9:
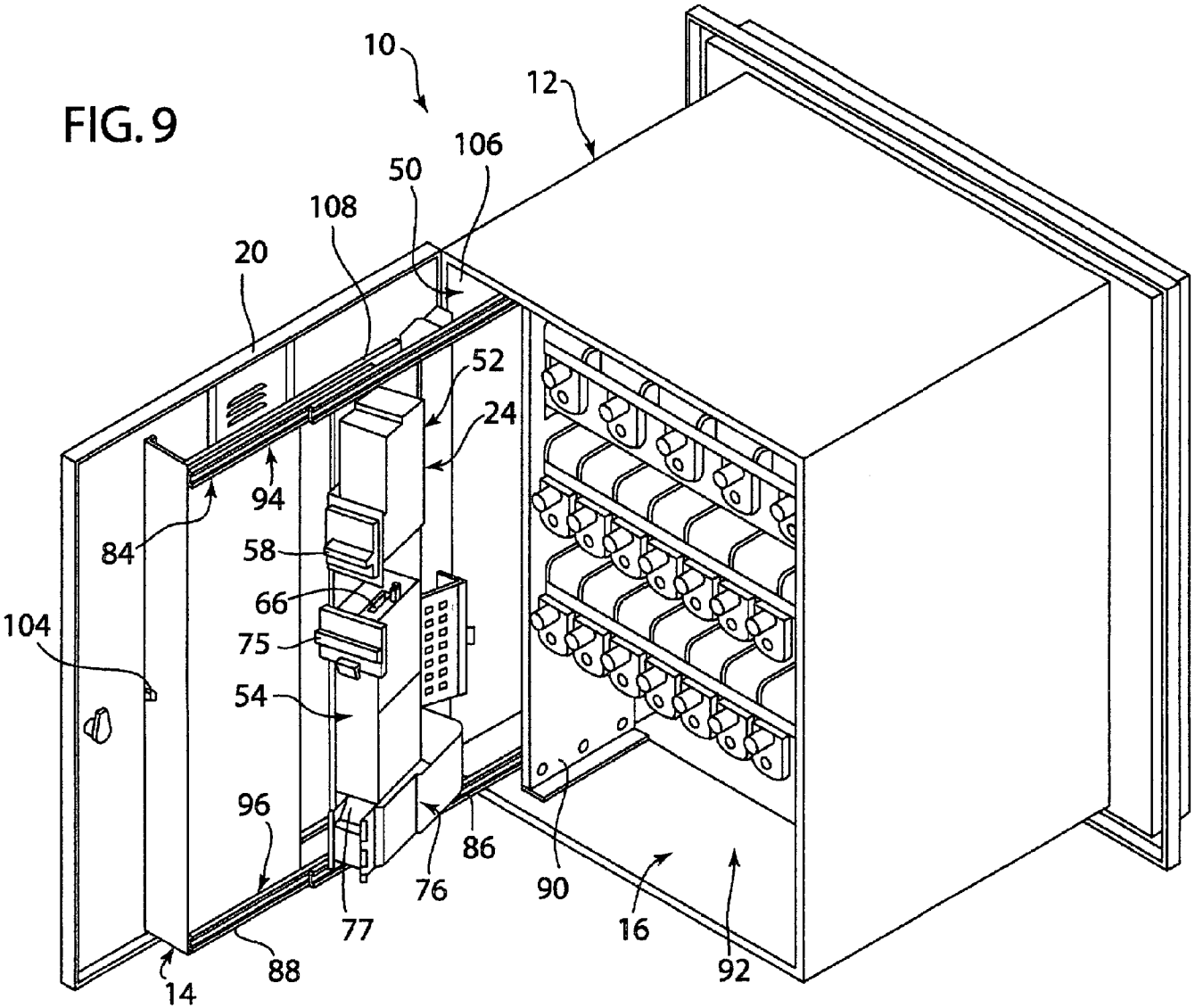
FIG. 9 is a rear perspective view of the rear loading vending machine embodying the present invention with the rear door in the open position and the chassis in a service position.
Figure 10:
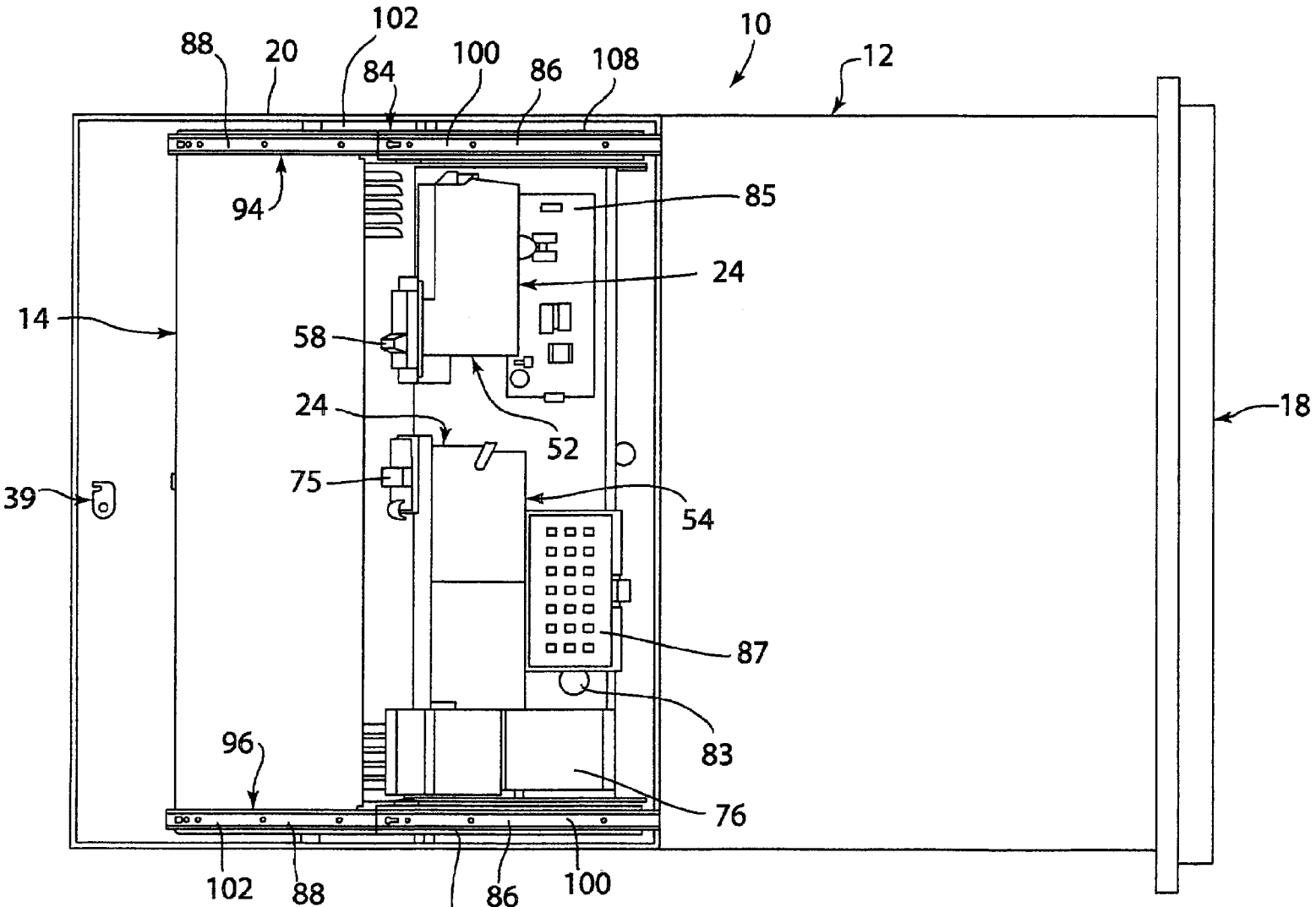
FIG. 10 is a side view of the rear loading vending machine embodying the present invention with the rear door in the open position and the chassis in the service position.

In the illustrated example, the interior 16 (FIGS. 7–10) of the vending machine 10 includes an interior panel 90 that separates the interior 16 into a control and money collection area 50 that houses the service chassis 14 and a vending area 92 that houses the shelves 40. The service chassis 14 includes a track 84 connecting the service chassis 14 to the housing 12 that allows the service chassis 14 to be slid into and out of the control and money collection area 50 of the interior 16 of the housing 12. The track 84 comprises an upper track section 94 and a lower track section 96. Both the upper track section 94 and the lower track section 96 include a first C-shaped track member 86 and a second C-shaped track member 88. The first C-shaped track members 86 include a first channel 100 configured to accept first rollers (not shown) connected to a side of the interior panel 90 facing the control and money collection area 50. The first C-shaped track members 86 further include second rollers (not shown) connected thereto on a side opposite to the first channel 100. The second C-shaped track members 88 include second channels 102 that are configured to accept the second rollers. Accordingly, as illustrated in FIG. 7, the service chassis 14 can move between a stored position (shown in phantom in FIG. 7) to an intermediate position by pulling the service chassis 14 out of the control and money collection area 50.

The illustrated service chassis 14 includes a pivotable frame member 80 and a security panel 82 connected to the track 84. The security panel 82 includes a lock 104 that engages a side wall 106 of the housing 12 to prevent the service chassis 14 from being moved to the intermediate position without a key to the lock 104. The security panel 82 has a substantially L-shaped cross-section and is connected at an upper end to the upper track section 94 and at a lower end to the lower track section 96. The security panel 82 includes an upper arm 108 pivotally connected to an upper portion of the pivotable frame member 80 and a lower arm 110 pivotally connected to a lower portion of the pivotable frame member 80.

In the illustrated example, the pivotable frame member 80 comprises a vertical plate 81 configured to rotate about the upper arm 108 and the lower arm 110 of the security panel 82. The pivotal frame member 80 is configured to rotate from the intermediate position (FIGS. 7 and 8) to a service position (FIGS. 9 and 10) by rotating the vertical plate 81 172° clockwise. The vertical plate 81 preferably includes a finger hole 83 for assisting in rotating the pivotable frame 80. The pivotable frame member 80 includes the at least one money collecting container 24 connected to the vertical plate 81. When the pivotable frame member 80 is in the service position, the at least one money collecting container 24 is accessible. In the illustrated example, the pivotable frame member 80 includes a circuit board 85 and a programming keyboard 87 for controlling the actuation of the rear loading vending machine 10 and for inputting various information to the control system of the rear loading vending machine 10, respectively. The various information inputted by the programming keyboard 87 can include the price for the vending product in a particular lane 42.

The illustrated at least one money collecting container 24 comprises a paper money stacker/validator 52 and a coin validator/changer 54 connected to the pivotable frame member 80. The paper money stacker/validator 52 includes an inlet 58 aligned with the paper money slot 30 in the money and selection panel 26 of the front face 18 of the housing 12. The paper money validator/stacker 52 as used and described in this application is commercially available from Mars Electronics International located in West Chester, Pa., under the part number VN 2512-U3MUS. The paper money stacker/validator 52 as used and described in this application is also commercially available from Coin Accepters Inc., also known as Coinco®, located in St. Louis, Mo., under the name "MAG52R." Those skilled in the art will appreciate that other similarly functioning paper money validator/stackers may be used. The coin validator/changer 54 includes an inlet 66 adapted to receive coins from the first coin slot 32 through a chute (not shown) connected to a rear wall of the money and selection panel 26. Coins accepted by the coin validator/changer 54 are placed into a coin vault 76 connected to the vertical plate 81. Coins not accepted by the coin validator/changer 54 or change for overpayments are placed into a coin return 77 that allows the unacceptable coins or change to be removed through the second coin slot 36 in the money and selection panel 26. The coin validator/changer 54 also preferably includes an LED or vacuum tube display 75 that communicates various information to the user of the rear loading vending machine 10 (e.g., the selection made by the user, "sold out," "correct change only," etc.) through an opening 73 in the money and selection panel 26. The coin validator/changer 54 as described in this application is commercially available from Coin Accepters Inc., also known as Coinco®, located in St. Louis, Mo., under the name "Quantum 700 Series." Those skilled in the art will appreciate that other similarly functioning coin validator/changers may be used. Although the cables and wiring of the components on the pivotable frame member 80 to the remainder of the rear loading vending machine 10 are removed for clarity, one skilled in the art will appreciate that the cables and wiring can lead along the rear ends of the shelves 40, down the interior panel 90, below the track 84 and to the service chassis 14 with suitable containment for the cables and wiring to hold the cables and wiring in position and to allow for the relief of strain of the cables and the wiring. Those skilled in the art will appreciate that other ways of connecting the service chassis 14 to the remainder of the rear loading vending machine are possible.

In the rear loading vending machine 10 of the present invention, the housing 12 can be placed in a wall of a building having an internal area allowing access to the rear loading vending machine 10 through the rear door 20. Additionally, the housing 12 can be placed adjacent a corner in the internal area and the rear door 20 will be able to open to allow access to the service chassis 14 in order to service the rear loading vending machine 10 and remove money from the money collecting containers 24.

Figure 11:
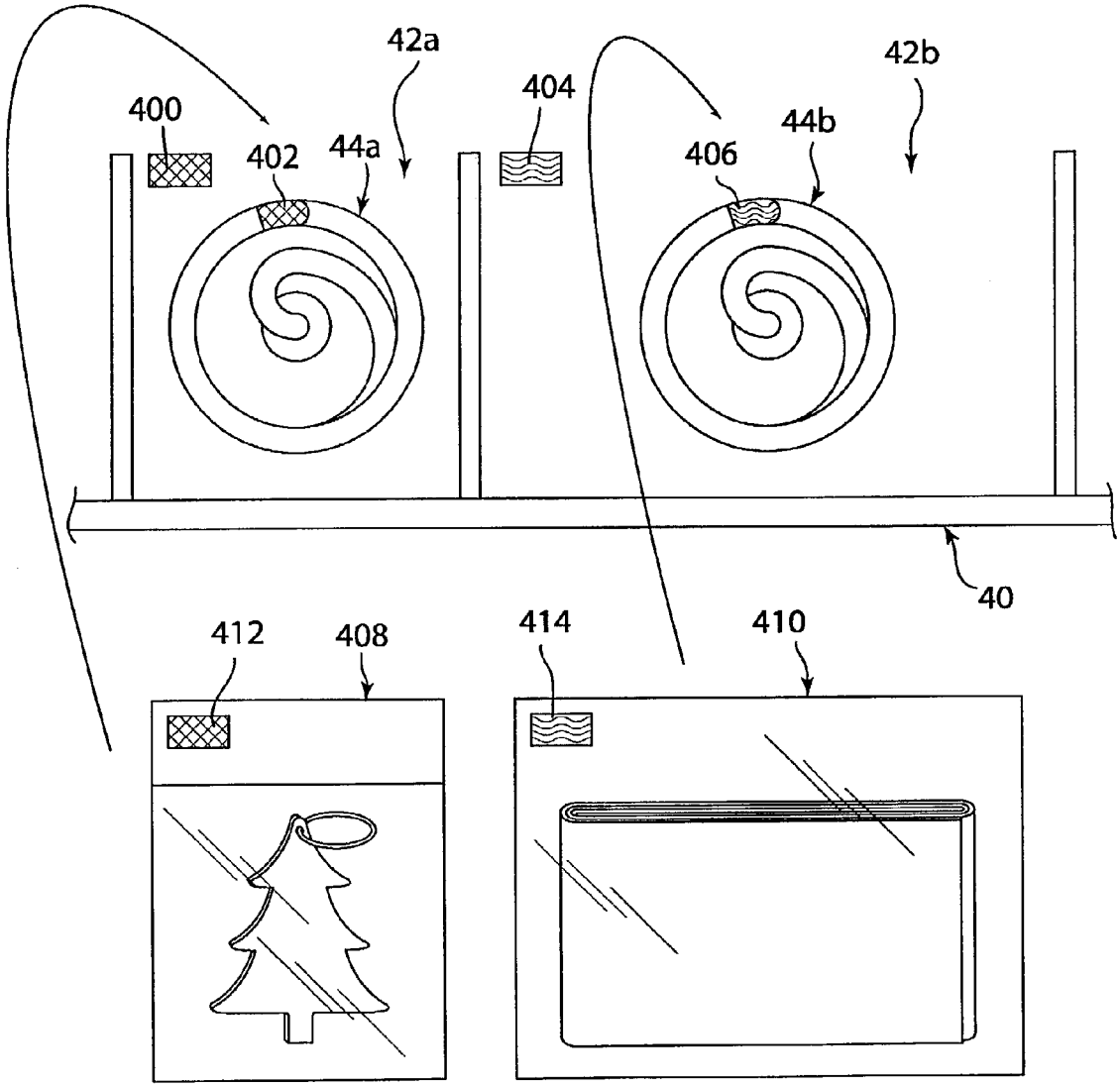
FIG. 11 is a front schematic view of a shelf of the vending machine and vending products.

FIG. 11 illustrates a preferred embodiment of the present invention and includes a system for preventing vending products from getting stuck in the lane 42 of the shelf 40 of the vending machine 10. In the preferred embodiment as illustrated in FIG. 11, the shelf 40 includes a first lane 42*a* having a first width and a second lane 42*b* having a second width. A first vending product 408 (e.g., an air freshener) is configured to be placed into the first lane 42*a* and has a width smaller than the first width of the first lane 42*a*. A second vending product 410 (e.g., a small towel) is configured to be placed into the second lane 42*b* and has a width smaller than the second width of the second lane 42*b*. The second vending product 410 has a larger width than the first lane 42*a* such that the second vending product 410 has a chance of getting stuck between walls of the first lane 42*a* if the second vending product 410 was placed in the first lane 42*a*.

Figure 12:
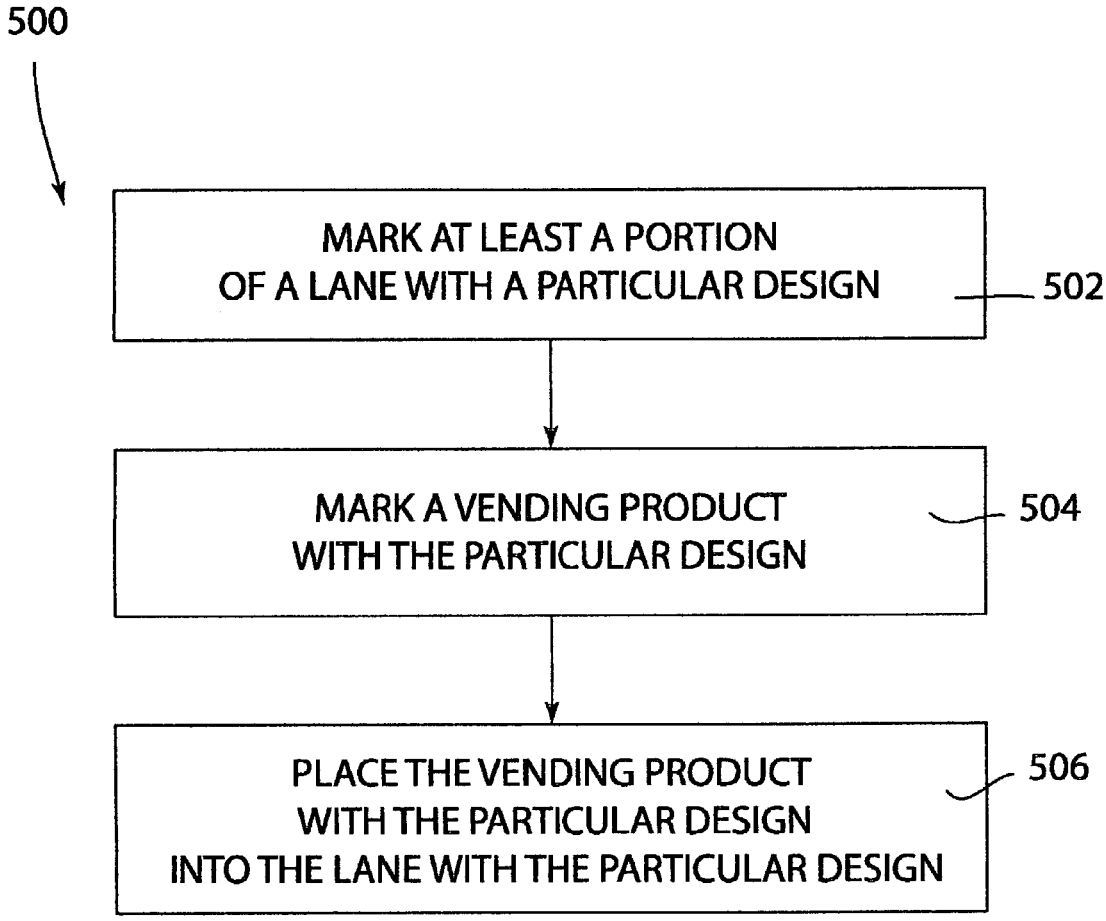
FIG. 12 discloses a block diagram illustrating a methodology for loading a vending machine of a preferred embodiment of the present invention.

The illustrated vending machine of the present invention enhances the reliability of the vending machine 10 by placing a vending product in a lane that is sized to accommodate the particular vending product. Referring to FIG. 12, a method 500 of loading a vending machine is shown. Beginning at step 502 of the method 500 of loading the vending machine, at least a portion of the lane of the vending machine is marked with a particular design. As illustrated in FIG. 11, the first lane 42*a* is marked by both placing a sticker 400 with a first design on a back wall of the first lane 42*a* and marking an end of the screw 44*a* with the first design at 402. The first design represents the width of the first lane 42*a*. The first design can be a particular color, a particular picture or any other design that will indicate the width of the first lane 42*a* through the design. Likewise, the second lane 42*b* is marked by both placing a sticker 404 with a second design on a back wall of the second lane 42*b* and marking an end of the screw 44*b* with the second design at 406. The second design represents the width of the second lane 42*b*. The second design can also be a particular color, a particular picture or any other design that will indicate the width of the second lane 42*b* through the design. Additionally, while both the first lane 42*a* and the second lane 42*b* include the stickers 400, 404 and the markings 402, 406 on the end of the screws 44*a*, 44*b*, respectively, it is contemplated that only the stickers 400, 404 or only the markings 402, 406 could be used. Furthermore, it is contemplated that any marking in the lanes 42*a*, 42*b* that would signify the width of the lanes 42*a*, 42*b* could be used. Preferably, each lane 42 in the vending machine 10 includes a particular design for each lane having a particular width.

After the lanes 42 have been marked at step 502, the vending products 408, 410 are marked with the particular design at step 504. The marks on the vending products 408, 410 signify that the particular vending product can easily fit within a particular lane 42 without getting stuck in the lane 42. As illustrated in FIG. 11, the first vending product 408 includes the first design 412 on the package. The first design 412 on the package of the first vending product 408 could be a sticker, ink directly on the package or any other manner of marking the first vending product 408. The first design 412 on the first vending product is identical to the design (sticker 400, marking 402, etc.) on the first lane 42*a*. Likewise, the second vending product 410 includes the second design 414 on the package. The second design 414 on the package of the second vending product 410 could be a sticker, ink directly on the package or any other manner of marking the first vending product. The second design 414 on the second vending product 410 is identical to the design (sticker 404, marking 406, etc.) on the second lane 42*b*. Although the step 504 of marking the vending product is shown as occurring after the step 502 of marking at least a portion of the lane, the step 504 could occur before the step 502 or the steps 502, 504 could occur simultaneously.

After the vending product has been marked at step 504, the vending product with the particular design is placed into the lane with the particular design at step 506. Therefore, the first vending product 408 will be placed in the first lane 42*a* and the second vending product 410 will be placed in the second lane 42*b*. The vending products 408, 410 will therefore easily move through the lanes 42*a*, 42*b* on the screws 44*a*, 44*b* without abutting the walls of the lanes 42*a*, 42*b*. Accordingly, the vending products 408, 410 will fall from their respective lanes once the particular vending product is chosen. Although the method 500 of loading a vending machine is preferably used with the rear loading vending machine 10, it is contemplated that the method 500 of loading a vending machine could be used with any vending machine.

Additionally, it is contemplated that the method 500 of loading a vending machine could be used with any method of moving the vending product along the lane and could even be used in a vending machine that supports the vending product from above with adjacent vending products and/or sides of the housing adjacent the vending product that define the lanes 42, such that the vending product does not get stuck between two adjacent vending products.

Figure 13:
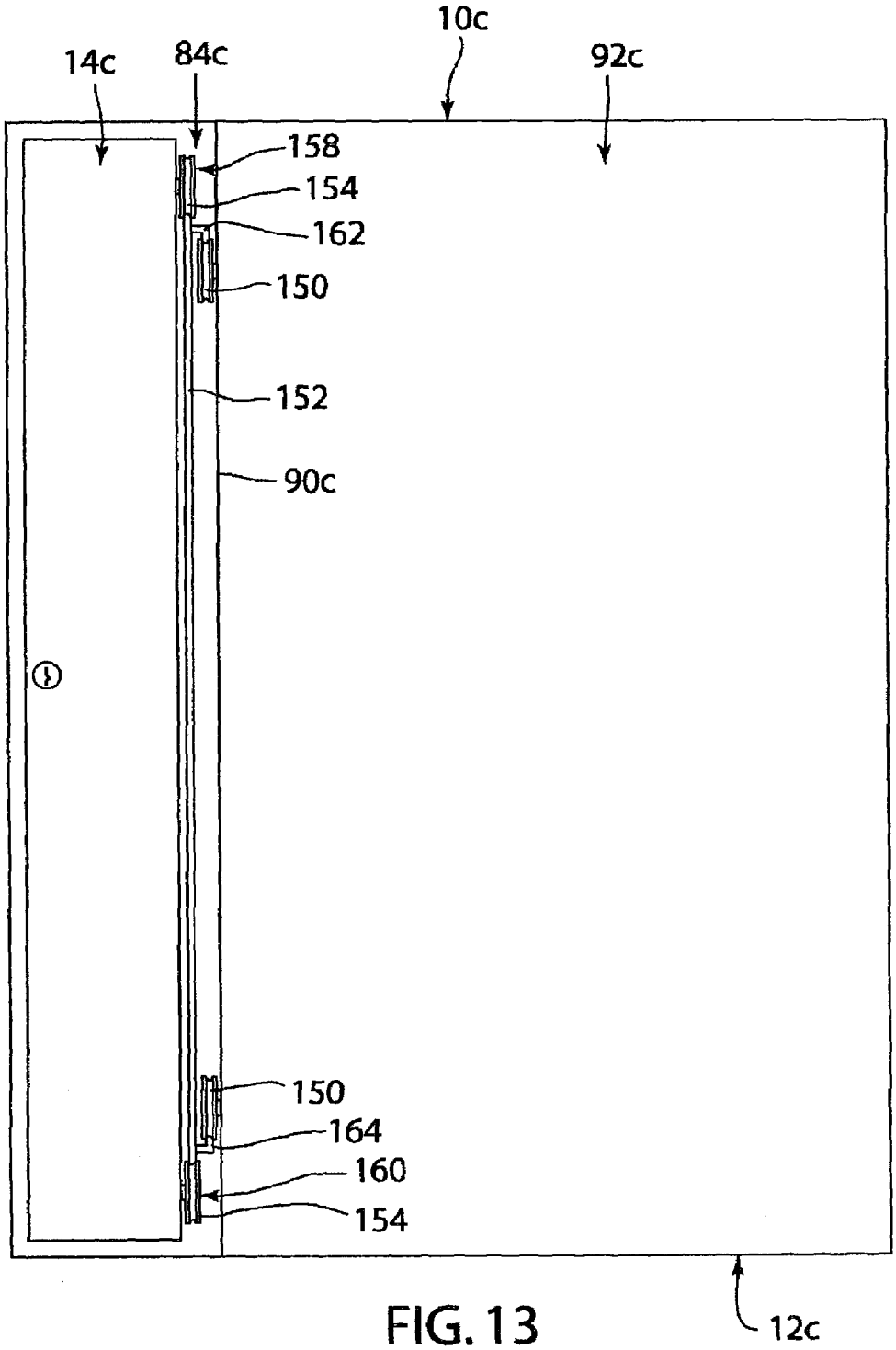
FIG. 13 is a front schematic view of the chassis connected to a housing of the rear loading vending machine of a second embodiment of the present invention.
Figure 14:
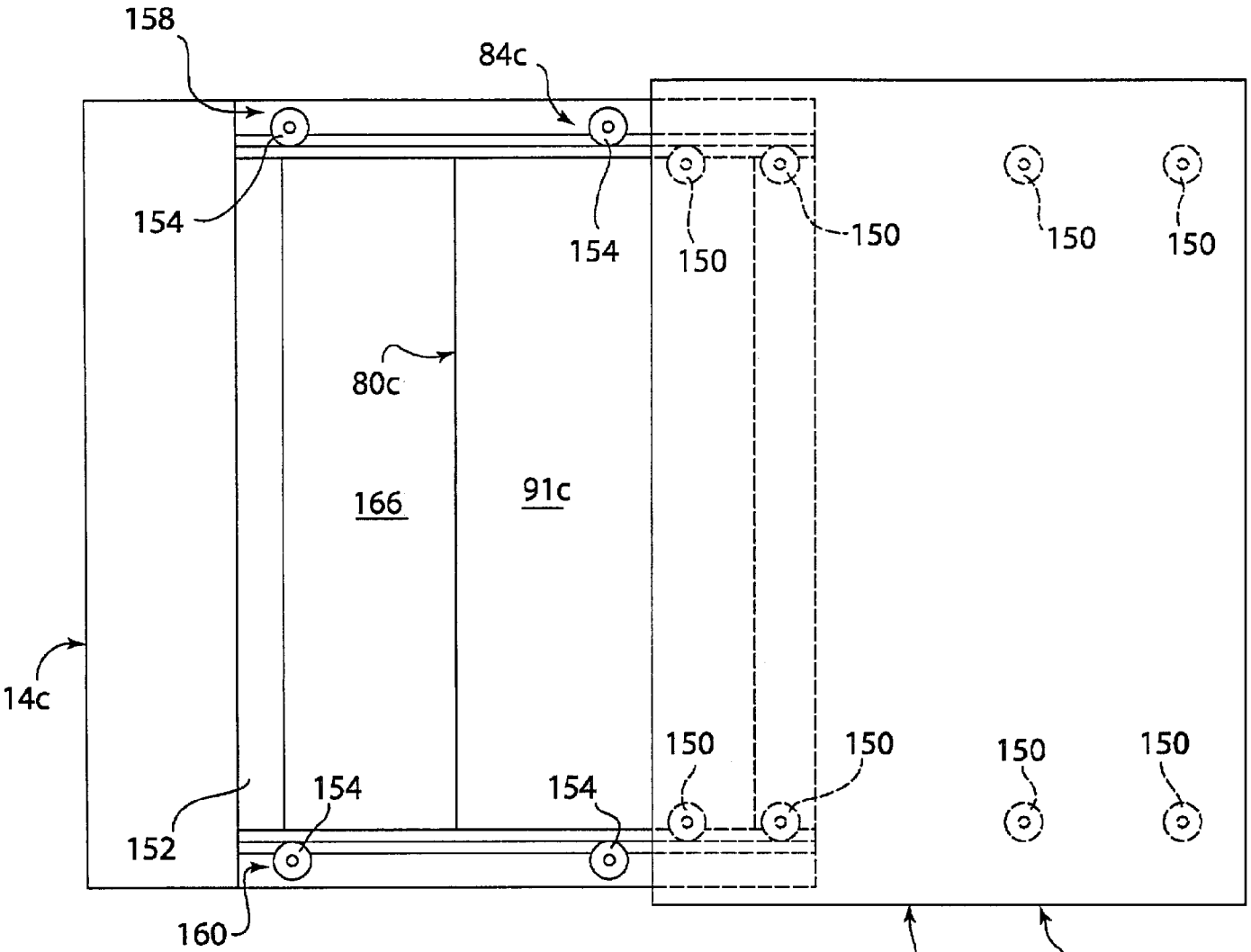
FIG. 14 is a side schematic of the chassis connected to the housing of the rear loading vending machine of a second embodiment of the present invention with the chassis in a service position.

The reference numeral 10*c* (FIGS. 13–14) generally designates another embodiment of the present invention, having a second embodiment for the rear loading vending machine. Since the rear loading vending machine 10*c* is similar to the previously described rear loading vending machine 10, similar parts appearing in FIGS. 1–10 and FIGS. 13–14, respectively, are represented by the same, corresponding reference number, except for the suffix "c" in the numerals of the latter. The second embodiment of the rear loading vending machine 10*c* is identical to the previously described rear loading vending machine 10, except that the rear loading vending machine 10*c* includes a different track 84*c*. FIG. 13 illustrates a rear view and FIG. 14 illustrates a side view of the rear loading vending machine 10*c* with the rear door removed and all of the elements located in the vending area 92*c* removed for clarity.

In the illustrated example, the track 84*c* includes a plurality of inside rollers 150 connected to the interior panel 90*c*, a middle sliding panel 152, and a plurality of outside rollers 154 connected to the service chassis 14*c*. The outside rollers 154 on the service chassis 14*c* include an upper row 158 of outside rollers 154 and a lower row 160 of outside rollers 154. The middle sliding panel 152 is located between the upper row 158 of outside rollers 154 and the lower row 160 of outside rollers 154. The middle sliding panel 152 is configured to roll on the outside rollers 154. The middle sliding panel 152 includes an upper bent flange 162 and a lower bent flange 164. The upper bent flange 162 is L-shaped and extends outward and then downward. The upper bent flange 162 extends outwardly below the upper row 158 of outside rollers 154 and towards the interior panel 90*c*. The lower bent flange 164 is also L-shaped and extends outward and then upward. The lower bent flange 164 extends outwardly above the lower row 160 of outside rollers 154 and towards the interior panel 90*c*. The upper bent flange 162 and the lower bent flange 164 capture the inside rollers 150 therebetween. As illustrated in FIG. 14, when the service chassis 14*c* is removed from the housing 12*c*, the middle sliding panel 152 supports the service chassis 14*c*. It is contemplated that the service chassis 14*c* and the middle sliding panel 152 include stops for preventing the service chassis 14*c* from being fully removed from the housing 12*c*. Additionally, as illustrated in FIG. 14, the middle sliding panel 152 includes a central opening 166 for allowing the pivotable frame member 80*c* to pivot through the middle sliding panel 152.

The reference numeral 10*d* (FIGS. 15–16) generally designates another embodiment of the present invention, having a third embodiment for the vending machine. Since the vending machine 10*d* is similar to the previously described rear loading vending machine 10, similar parts appearing in FIGS. 1–10 and FIGS. 15–16, respectively, are represented by the same, corresponding reference number, except for the suffix "d" in the numerals of the latter. The third embodiment of the vending machine 10*d* is substantially identical to the previously described rear loading vending machine 10, except that the vending machine 10*d* is a front loading vending machine. The front loading vending machine 10*d* is preferably located in a wall similarly to the rear loading vending machine 10*d*. The front loading vending machine 10*d* includes a front door 200 pivotally attached to a housing 12*d* and allowing access to an interior 16*d* of the housing 12*d*.

Figure 15:
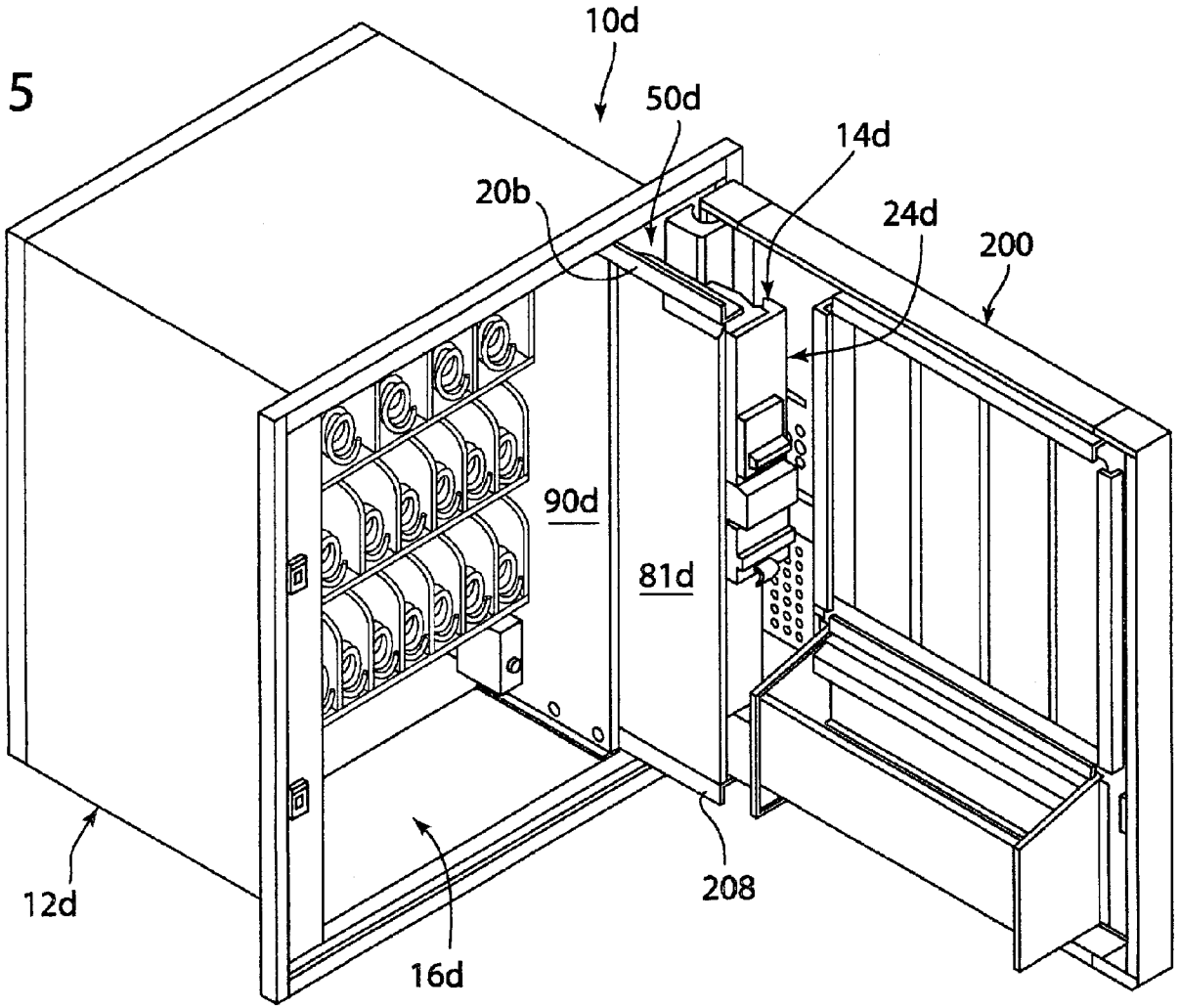
FIG. 15 is a front perspective view of a loading vending machine embodying a third embodiment of the present invention with a front door in an open position and a chassis in an intermediate position.
Figure 16:
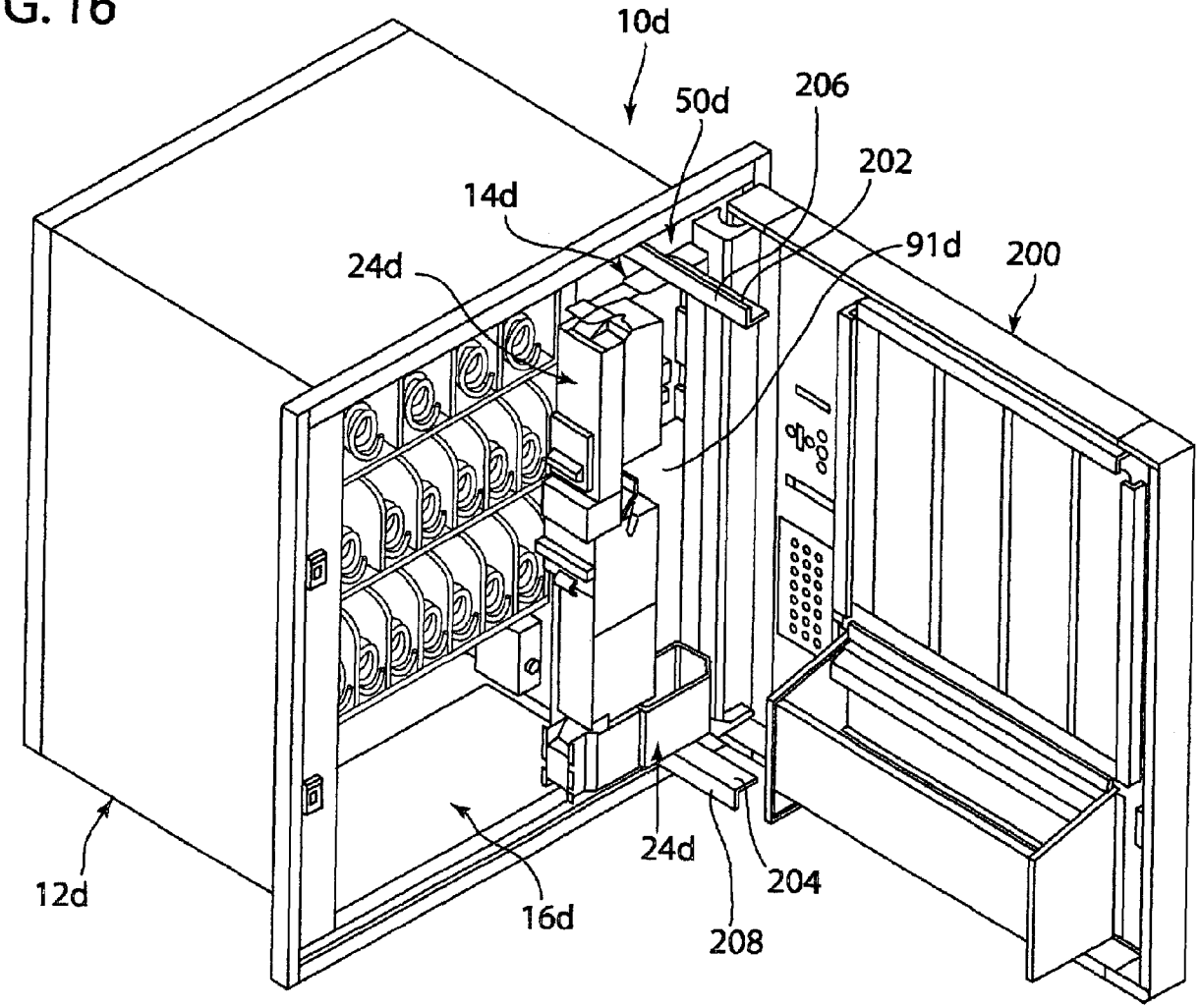
FIG. 16 is a rear perspective view of the loading vending machine embodying the third embodiment of the present invention with the rear door in the open position and the chassis in a service position.

In the illustrated example, a service chassis 14*d* is configured to be slid out of a control and money collection area 50*d* of the housing 12*d* of the front loading vending machine 10*d* when the front door 200 is in an open position (FIGS. 15 and 16). The service chassis 14*d* includes at least one money collecting container 24*d*. The service chassis 14*d* includes an upper arm 202 and a lower arm 204 connected to an interior panel 90*d* by an upper drawer slide 206 and a lower drawer slide 108, respectively. The upper arm 202 and the lower arm 204 are connected to a vertical plate 81*d*. The at least one money collecting containers 24*d* are connected to the vertical plate 81*d*. As illustrated in FIG. 16, the vertical plate 81*d* is pivoted about the upper arm 202 and the lower arm 204 to allow access to the at least one money collecting container 24*d*.

In the forgoing description, it will be readily appreciated by those skilled in the art that modifications may be made to the invention without departing from the concepts disclosed herein. Such modifications are to be considered as included in the following claims, unless these claims by their language expressly state otherwise.

We claim:

1. A vending machine comprising:

a housing having a front, a rear, a top, a bottom and two sides, the front, rear, top, bottom and two sides defining an interior of the housing;

the front of the housing including a front wall having at least one front opening configured to allow a vending product to be removed from the housing;

a rear door pivotally connected to the housing and covering at least a portion of the rear of the housing, the rear door having an open position allowing access to the interior of the housing, the rear door further having a closed position for preventing access to the interior of the housing through the rear of the housing; and a service chassis having at least one money collecting container;

wherein the service chassis is configured to be located within the interior of the housing when the rear door is in the closed position, the at least one money container having a money accepting slot adjacent the front of the housing when the service chassis is within the interior of the housing whereby money is inserted into the at least one money collecting container through the money accepting slot; and wherein the service chassis is configured to be at least partially removed from the interior of the housing through the rear of the housing to allow access to the at least one money collecting container and the money accepting slot of the at least one money collecting container.

2. The vending machine of claim 1, wherein:

the housing includes a track located within the housing allowing the service chassis to be slid into and out of the interior of the housing; and the service chassis includes a pivotal frame member pivotally interconnected to the track, thereby allowing the service chassis to be pivoted after the service chassis is slid out of the interior of the housing.

3. The vending machine of claim 2, wherein:

the service chassis further includes a security panel connecting the pivotal frame member to the track;

the security panel including a lock configured to lock the service chassis within the housing.

4. The vending machine of claim 3, wherein:

the at least one money collecting container is connected to the pivotal frame member.

5. The vending machine of claim 1, wherein:

the housing further includes a plurality of shelves, each shelf divided into a plurality of lanes, each lane being configured to support a vending product.

6. The vending machine of claim 5, wherein:

each lane includes a design signifying a width of the lane for allowing a proper vending product to be placed within the lane.

7. The vending machine of claim 6, wherein:

the design is located on a back wall of each lane.

8. The vending machine of claim 6, wherein:

each lane includes a screw for moving the vending products; and the design is located on an end of the screw of each lane.

9. The vending machine of claim 1, wherein:

the at least one money collecting container includes a coin vault and a paper money stacker.

10. A vending machine comprising:

a housing having an interior, a front face and a rear door pivotally connected to the housing, the front face of the housing including at least one front opening for allowing a vended product to be removed from the housing; and a service chassis at least partially located within the housing, the service chassis having at least one money collecting container;

wherein the housing includes a track located within the housing allowing the service chassis to be slid into and out of the interior of the housing;

wherein the service chassis includes a pivotable frame member, thereby allowing the pivotable frame member to be pivoted after the service chassis is slid out of the interior of the housing; wherein the service chassis further includes a security panel connecting the pivotal frame member to the track; and the security panel including a lock configured to lock the service chassis within the housing.

11. The vending machine of claim 10, wherein:

the at least one money collecting container is connected to the pivotal frame member.

12. The vending machine of claim 10, wherein:

the housing further includes a plurality of shelves, each shelf divided into a plurality of lanes, each lane being configured to support a vending product.

13. A vending machine comprising:

a housing having an interior, a front face and a rear door pivotally connected to the housing, the front face of the housing including at least one front opening for allowing a vended product to be removed from the housing; and a service chassis at least partially located within the housing, the service chassis having at least one money collecting container;

wherein the housing includes a track located within the housing allowing the service chassis to be slid into and out of the interior of the housing;

wherein the service chassis includes a pivotable frame member, thereby allowing the pivotable frame member to be pivoted after the service chassis is slid out of the interior of the housing;

wherein the housing further includes a plurality of shelves, each shelf divided into a plurality of lanes, each lane being configured to support a vending product; and wherein each lane includes a design signifying a width of the lane for allowing a proper vending product to be placed within the lane.

14. The vending machine of claim 13, wherein:

the design is located on a back wall of each lane.

15. The vending machine of claim 13, wherein:

each lane includes a screw for moving the vending products; and the design is located on an end of the screw of each lane.

16. The vending machine of claim 10, wherein:

the at least one money collecting container includes a coin vault and a paper money stacker.

17. A vending machine comprising:

a housing having an interior, a front face and a door pivotally connected to the housing, the front face of the housing including at least one front opening for allowing a vended product to be removed from the housing;

a service chassis at least partially located within the housing, the service chassis having at least one money collecting container;

wherein the housing includes a track located within the housing allowing the service chassis to be slid into and out of the interior of the housing;

wherein the service chassis includes a pivotable frame, thereby allowing the pivotable frame to be pivoted after the service chassis is slid out of the interior of the housing; and wherein the at least one money collecting container is located on the pivotable frame and includes a coin vault.

18. The vending machine of claim 17, wherein:

the housing further includes a plurality of shelves, each shelf divided into a plurality of lanes, each lane being configured to support a vending product.

19. A vending machine comprising:

a housing having an interior, a front face and a door pivotally connected to the housing, the front face of the housing including at least one front opening for allowing a vended product to be removed from the housing; and a service chassis at least partially located within the housing, the service chassis having at least one money collecting container;

wherein the housing includes a track located within the housing allowing the service chassis to be slid into and out of the interior of the housing;

wherein the service chassis includes a pivotable frame, thereby allowing the pivotable frame to be pivoted after the service chassis is slid out of the interior of the housing;

wherein the housing further includes a plurality of shelves, each shelf divided into a plurality of lanes, each lane being configured to support a vending product; and wherein each lane includes a design signifying a width of the lane for allowing a proper vending product to be placed within the lane.

20. The vending machine of claim 19, wherein:

the design is located on a back wall of each lane.

21. The vending machine of claim 19, wherein:

each lane includes a screw for moving the vending products; and the design is located on an end of the screw of each lane.

22. The vending machine of claim 17, wherein:

the at least one money collecting container further includes a paper money stacker.

23. The vending machine of claim 17, wherein:

the door is a front door.

24. A vending machine comprising:

a housing having an interior, a front face and a rear door pivotally connected to the housing, the front face of the housing including at least one front opening for allowing a vended product to be removed from the housing; and a service chassis at least partially located within the housing, the service chassis having at least one money collecting container;

wherein the housing includes a track located within the housing allowing the service chassis to be slid into and out of the interior of the housing;

wherein the service chassis includes a pivotable frame member, thereby allowing the pivotable frame member to be pivoted after the service chassis is slid out of the interior of the housing; and wherein the service chassis is configured to be slid out of the interior through a rear of the housing on the track when the rear door is opened, but cannot slide out of the interior of the housing when the rear door is closed.

25. A vending machine comprising:

a housing having an interior, a front face and a door pivotally connected to the housing, the front face of the housing including at least one front opening for allowing a vended product to be removed from the housing; and a service chassis at least partially located within the housing, the service chassis having at least one money collecting container;

wherein the housing includes a track located within the housing allowing the service chassis to be slid into and out of the interior of the housing;

wherein the service chassis includes a pivotable frame, thereby allowing the pivotable frame to be pivoted after the service chassis is slid out of the interior of the housing; and wherein the service chassis is configured to be slid out of the interior through a rear of the housing on the track when the rear door is opened, but cannot slide out of the interior of the housing when the rear door is closed.

* * * * *